United States Patent [19]

Jung

[11] 4,256,048

[45] Mar. 17, 1981

[54] KNIFE MECHANISM FOR TWIN NEEDLE SEWING APPARATUS

[75] Inventor: Wilhelm H. Jung, Mechanicsville, Va.

[73] Assignee: AMF Incorporated, White Plains, N.Y.

[21] Appl. No.: 82,821

[22] Filed: Oct. 9, 1979

[51] Int. Cl.[3] ..... D05B 65/02

[52] U.S. Cl. ..... 112/292

[58] Field of Search ..... 112/292, 291, 297, 298, 112/296, 299, 163, 167

[56] References Cited

U.S. PATENT DOCUMENTS

| | | | |
|---|---|---|---|
| 2,826,160 | 3/1958 | Adams | 112/298 X |
| 3,211,117 | 10/1965 | Speichermann et al. | 112/292 |
| 3,776,161 | 12/1973 | Papajewski et al. | 112/292 |
| 3,894,502 | 7/1975 | Hager et al. | 112/298 X |
| 4,043,283 | 8/1977 | Jung | 112/163 |

*Primary Examiner*—H. Hampton Hunter

*Attorney, Agent, or Firm*—George W. Price; Charles J. Worth

[57] ABSTRACT

Apparatus for simultaneously cutting both needle threads and both bobbin threads for a twin needle tacker or the like; the apparatus being mounted to the bottom of the throat plate and being removable with the throat plate as a single unit.

5 Claims, 10 Drawing Figures

KNIFE MECHANISM FOR TWIN NEEDLE SEWING APPARATUS

This invention relates generally to sewing apparatus or machines and more particularly to means on industrial type sewing machines for trimming or cutting threads.

Knives for trimming needle and/or bobbin threads are widely used on industrial type sewing machines. Single knife assemblies driven by linkages are common and work in conjunction with single needle tackers and, of course, trim only one needle thread and/or one bobbin thread. The designs of knife assemblies vary and may be mounted on top of or under the throat plate of the machine. Knife assemblies are also available as self-contained attachments for mounting to sewing heads.

With the work advancing mechanism, the shuttle drive and the bobbin thread feed mechanism, there is only a limited amount of unused space available for a knife assembly under the throat plate which is the preferred location to keep the knife assembly away from the work area. The lack of available space obviously is amplified in twin needle sewing apparatus as may be exemplified by the machine shown, described and claimed in my U.S. Pat. No. 4,043,283 granted Aug. 23, 1977.

Accordingly, an object of the present invention is to provide means in a twin needle sewing apparatus for simultaneously cutting both needle threads and both bobbin threads.

Another object of the present invention is to provide the foregoing means under the throat plate of the machine.

And, another object of the present invention is to provide the foregoing means which may be operated either automatically or manually.

Still another object of the present invention is to provide thread cutting means which can be changed with facility when the spacing between the needles is changed.

The foregoing and other objects and advantages will appear more fully hereinafter from a consideration of the detailed description wherein one embodiment of the invention is illustrated by way of example. It is to be expressly understood, however, that the drawing is for illustration purposes only and is not to be construed as defining the limits of the invention.

Figure 2A:
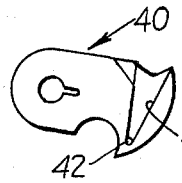
FIG. 2A is a plan view of one of the rotatable cutting blades of FIG. 2.
Figure 2:
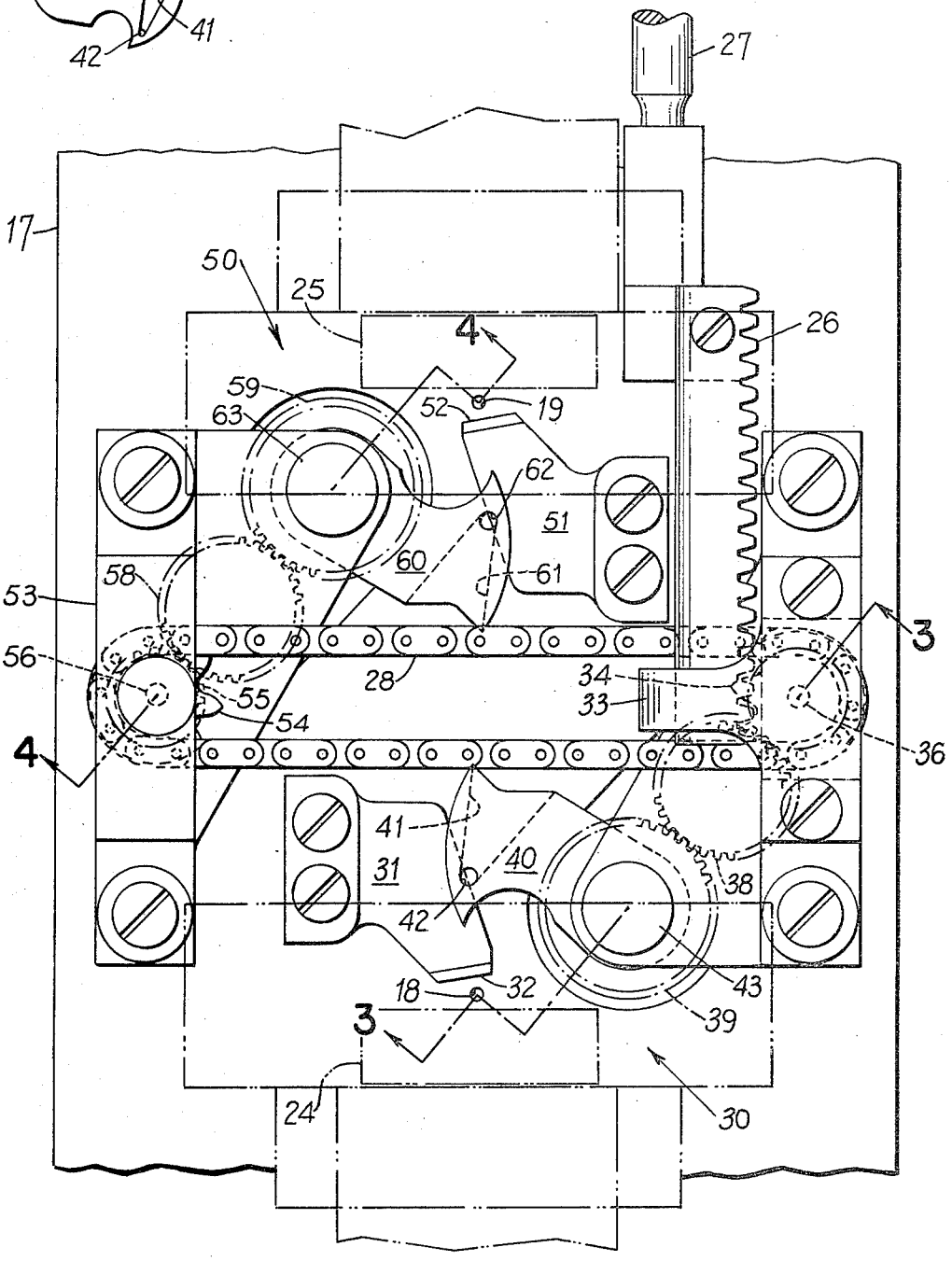
FIG. 2 is a bottom plan view of a thread cutting means made in accordance with the present invention which is located under the throat plate of the machine of FIG. 1.
Figure 3:
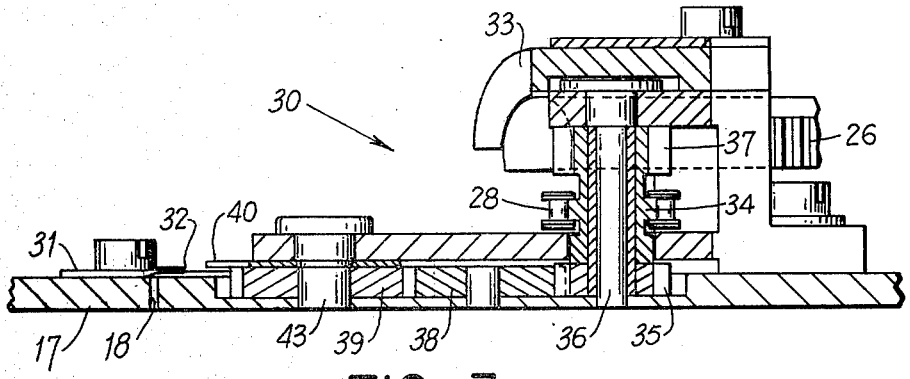
Figure 4:
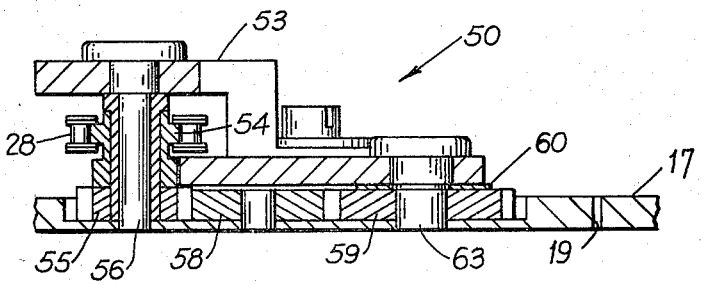

FIGS. 3 and 4 are sectional views taken on line 3—3 and 4—4, respectively, of FIG. 2.

FIGS. 5 to 9 are views, on a reduced scale, similar to FIG. 2 illustrating the sequence of operation of the novel cutting means.

Figure 1:
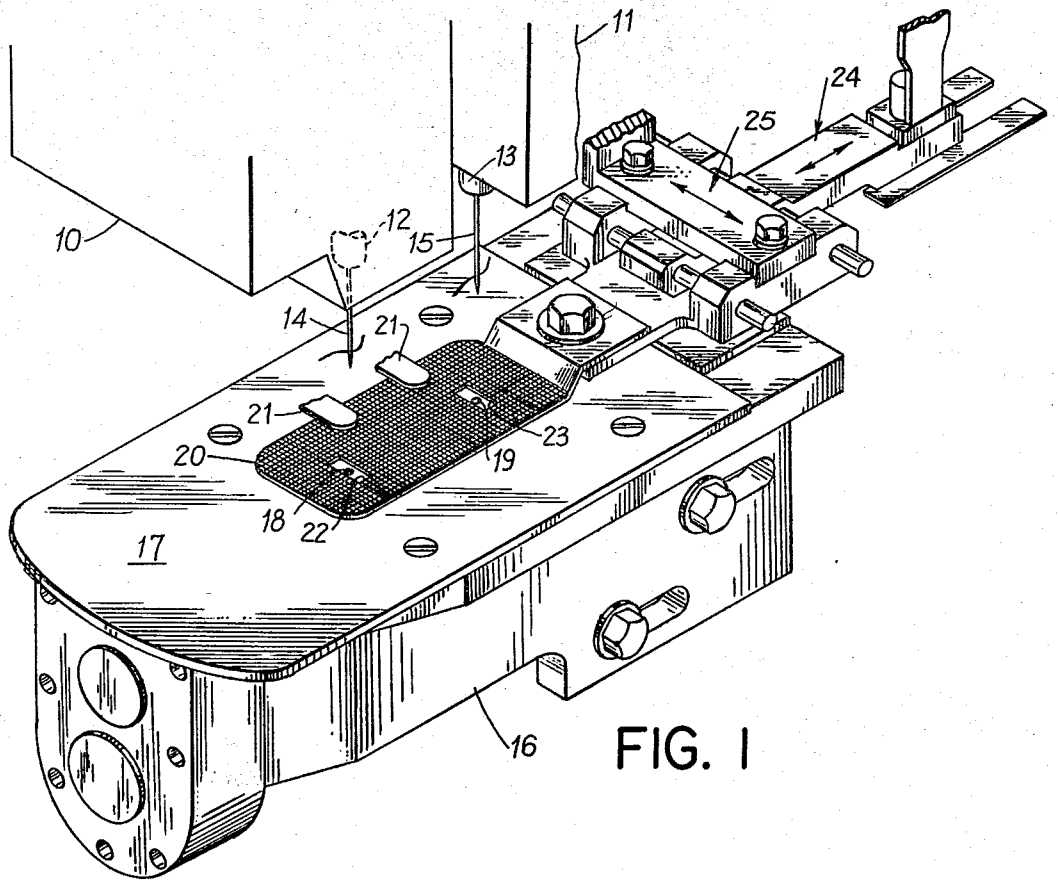
FIG. 1 is a perspective view of the working end of a twin needle sewing apparatus providing utility for the present invention.

Referring now to the drawings and particularly to FIG. 1, a sewing apparatus (shown in part) has a head providing spaced needle bar housings 10 and 11, and a work support table or bed formed by a throat plate 17 mounted on a frame 16. The sewing apparatus discussed herein is essentially the same apparatus as shown, described and claimed in my U.S. Pat. No. 4,043,283 granted Aug. 23, 1977 and assigned to the same assignee as the present application.

Needle bars 12 and 13, provided with respective sewing needles 14 and 15, are supported in and are reciprocally driven by means (not shown) in the housings 10 and 11, respectively, as shown in U.S. Pat. No. 4,043,283. The throat plate 17 is provided with a pair of spaced needle holes 18 and 19 appropriately aligned with needles 12 and 13, respectively.

A clamp assembly for receiving and positioning the materials to be joined together during the sewing operation comprises a clamp plate 20 disposed on the throat plate 17 and a pair of fingers 21. The clamp plate 20 is provided with a spaced pair of openings or slots 22 and 23 which are suitably aligned with needle holes 18 and 19, respectively, and are of suitable size to prevent the clamp plate 20 from interfering with needles 14 and 15 as the materials are moved along a predetermined path during the sewing operation. The clamp assembly is provided with longitudinal drive means 24 and lateral drive means 25 which correspond to and operate in the same manner as such drive means of U.S. Pat. No. 4,043,283.

Referring now to FIG. 2, a spaced pair of shuttles with bobbins and cases as indicated at 24 and 25, generally corresponding to and driven in the same manner as the bobbins and cases of my U.S. Pat. No. 4,043,283, are disposed below the throat plate 17 adjacent the needle holes 18 and 19, respectively. A spaced pair of thread cutting mechanisms 30 and 50 are mounted on the bottom of the throat plate 17 between the spaced shuttles, bobbin and case assemblies 24 and 25 which may be similar to such assemblies shown in U.S. Pat. No. 3,776,161.

Referring also to FIG. 3, the cutting mechanism 30 is provided with a fixed blade 31 mounted to the bottom of the throat plate 17 and having a cutting face 32 in spaced face to face relation with the shuttle, bobbin and case means 24 and on the opposite side of the needle hole 18 therefrom. The movable parts of this mechanism also are mounted on the throat plate 17 by bracket means 33. As shown, a sprocket 34 and a drive gear 35 are mounted to rotate together on a shaft 36 and in unison with a pinion 37 also mounted on this shaft. The drive gear 35 meshes with an idler or idle gear 38 which meshes with a driven gear 39. The driven gear 39 and a blade 40 are mounted to rotate in unison on a shaft 43. The edges of blade 40 have formed recesses as shown to facilitate picking threads as the blade 40 rotates while the side of the blade facing the throat plate 17, best shown in FIG. 2A, is provided with a tapered or V-shaped notch or recess 41 with a hole at its smaller end forming a cutting edge 42 which cooperates with the cutting edge 32 of fixed blade 31 to cut or shear the picked threads as the blade 40 rotates in a horizontal plane away from the shuttle/bobbin assembly 25, as will be further discussed. The pinion 37 is in mesh with a rack gear 26 mounted on the end of a push/pull rod 27 which operates the knife assembly 30 as will be further discussed.

Referring now to FIGS. 2 and 4, the cutting mechanism or knife assembly 50 is similar to the cutting mechanism or knife assembly 30 and is provided with a fixed blade 51 mounted to the bottom of the throat plate 17 and having a cutting edge 52 disposed in spaced face to face relation with the shuttle/bobbin assembly 25 and on the opposite side of the needle hole 19 therefrom.

The movable parts of this mechanism also are mounted on the throat plate 17 by bracket means 53. As shown, a sprocket 54 and a drive gear 55 are mounted to rotate together on a shaft 56. The drive gear 55 meshes with an idler gear 58 which also meshes with a driven gear 59. The driven gear 59, and a blade 60, similar to blade 40, are mounted to rotate in unison on a shaft 63. The edges of blade 60 have formed recesses as shown to facilitate picking threads as the blade 60 rotates while the side of the blade facing the throat plate 17 is provided with a tapered or V-shaped notch or recess 61 with a hole at its smaller end forming a cutting edge 62 which cooperates with the cutting edge 52 of fixed blade 51 to cut or shear the picked threads as the blade 60 rotates in a horizontal plane away from the shuttle/bobbin assembly 24, as will be further discussed.

To interconnect the cutting mechanisms or blade assemblies 30 and 50 for operation in unison for simultaneously cutting needle and bobbin threads from both rows of stitches in response to movement of rod 27, a roller chain 28 or a lugged belt (not shown) encircles and is engaged by sprockets 34 and 54. The rod 27, when the desired rows of stitches have been completed, can be manually operated or automatically operated by being connected to and intergrated into the operation of the cam feed drive of my U.S. Pat. No. 4,043,283 or any other suitable automatic control means known in the art.

When the head 10 with needle 14 is moved relative to the fixed head 11 with needle 13 to adjust the space between the tacks to be made, it is obvious that the location of the shuttle/bobbin 24 and the cutting mechanism or knife assembly 30 must also be adjusted. Also, since the interspace between the needle holes 18 and 19 is fixed, the throat plate 17 must be replaced. Since the cutting mechanisms or blade assemblies 30 and 50 and the interconnecting drive therefore are mounted on the bottom of the throat plate 17 and located also relative to the location of the needle holes 18 and 19, the throat plate and cutting mechanisms are replaced as a single preset unit which requires no further adjustment for use.

OPERATION

Figure 5:
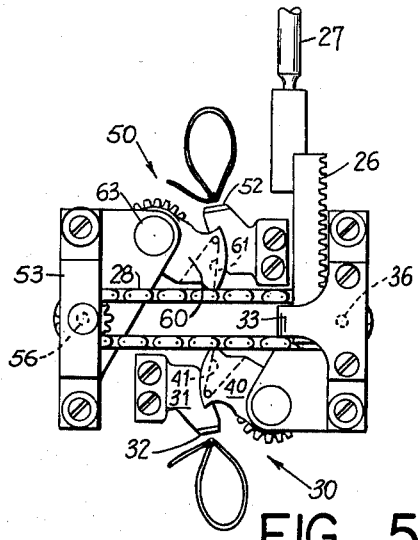

The cutting mechanisms or blade assemblies 30 and 50 are shown in FIGS. 2 and 5 in their quiescent or unoperated position during a stitching operation, loops of thread extending through needle holes 18 and 19 being shown in FIG. 5.

Figure 6:
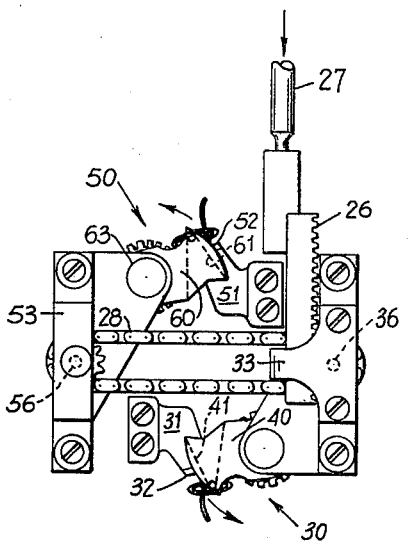
Figure 7:
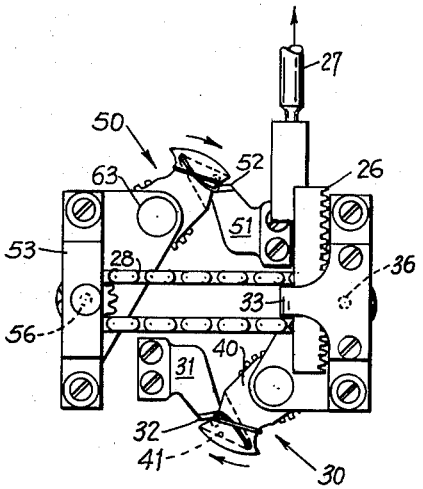

As the rod 27 is moved from right to left as viewed in the drawings or toward the cutting mechanisms or blade assemblies 30 and 50, the gear train comprising the rack gear 26, pinion 37, drive gear 35, idler gear 38 and driven gear 39 translates the linear rod movement to rotary movement causing the blade 40 to rotate in a counterclockwise direction past the needle hole 18 progressively picking up the thread loop thereat as shown in FIGS. 6 and 7. Sprocket 34 being rotated by the gear train of blade assembly 30 and drivingly connected by the roller chain 28 to the sprocket 54 drives the gear train comprising drive gear 55, idler gear 58 and driven gear 59 of the blade assembly 50 causes the blade 60 to rotate simultaneously with blade 40 in a counterclockwise direction past the needle hole 19 progressively picking up the thread loop thereat.

Figure 8:
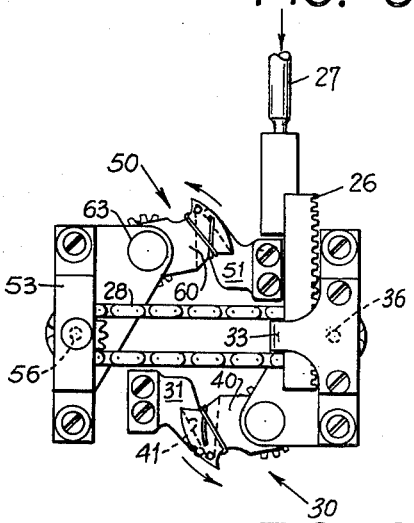
Figure 9:
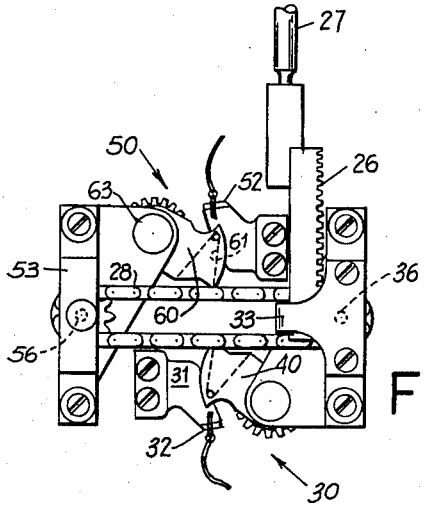

Upon the reverse stroke of rod 27 moving in a direction from left to right as viewed in the drawings, the gear trains cause the blades 40 and 60 to rotate simultaneously in a clockwise direction picking the bobbin threads. As the cutting edges 42 and 62 of the respective blades 40 and 60 move past the cutting edges 32 and 52 of fixed blades 31, and 51, respectively, as shown in FIG. 8, cooperation of the cutting edges simultaneously shear or cut both the needle thread loops and bobbin threads as the blades 40 and 60 return to their initial quiescent positions at the end of the return stroke of rod 27 as shown in FIG. 9.

As should be readily seen, there is only a minimal amount of room available for the twin knife assemblies 30 and 50, and the blades 40 and 60 require about a 80 to 90 degree throw to fully pick up and simultaneously cut the threads as shown.

Although but a single embodiment of the invention has been illustrated and described in detail, it is to be expressly understood that the invention is not limited thereto. Various changes may also be made in the design and arrangement of the parts without departing from the spirit and scope of the invention as the same will now be understood by those skilled in the art.

What is claimed is:

1. Apparatus for use in a sewing machine having a pair of reciprocally driven sewing needles spaced apart from one another and a pair of bobbin/shuttle assemblies suitably positioned and spaced apart from one another for operatively cooperating with said pair of sewing needles during the sewing operation, comprising a throat plate disposed above said pair of bobbin/-shuttle assemblies and having a pair of needle holes suitably located and spaced from one another to permit passage of said sewing needles through said throat plate during the sewing operation;

a pair of cutting mechanisms mounted on the bottom of said throat plate and being disposed in the space between said bobbin/shuttle assemblies;

said cutting mechanisms each being disposed adjacent a different one of said bobbin/shuttle assemblies for picking and cutting the threads of said adjacent bobbin/shuttle assembly and the sewing needle operatively cooperating therewith when operated;

each of said cutting mechanisms being provided with a fixed blade and a rotatable blade to be driven;

said fixed blade having a cutting edge disposed in spaced face to face relation with the adjacent bobbin/shuttle assembly;

said rotatable blade when driven picking threads of said adjacent bobbin/shuttle assembly and the sewing needle cooperative therewith and having a cutting edge cooperating with the cutting edge of said fixed blade to cut the picked threads;

at least one of said cutting mechanisms being adapted to be operated at the end of a sewing operation; and means operatively connecting said pair of cutting mechanisms together.

2. The apparatus in accordance with claim 1, and each of said cutting mechanisms and the adjacent bobbin/shuttle assembly being disposed on opposite sides of one of said needle openings from the other.

3. The apparatus in accordance with claim 2, and each of said cutting mechanisms being provided with gear means for driving the rotatable blade; and an endless belt means engaging and drivingly interconnecting said gear means together causing said rotating blades to move in unison.

4. The apparatus in accordance with claim 3, and each of said gear means comprising a gear train;

one gear of at least one of said gear trains being adapted to be engaged and driven by a reciprocally actuated rack gear for causing said cutting mechanisms to be operated; and said endless belt means being a link chain loop.

5. The apparatus in accordance with claim 4, wherein said throat plate, cutting mechanisms and chain loop are removably mounted on a sewing machine as a single unit.

* * * * *